US009694392B2

(12) United States Patent
Bailey et al.

(10) Patent No.: US 9,694,392 B2
(45) Date of Patent: Jul. 4, 2017

(54) SCREEN PANEL FRAME WITH PLATE

(71) Applicant: Rotex Global, LLC, Cincinnati, OH (US)

(72) Inventors: Scott A. Bailey, Cincinnati, OH (US); Nicholas P. Gardner, Cleves, OH (US); Dustin M. MacFarland, Trenton, OH (US)

(73) Assignee: Rotex Global, LLC, Cincinnati, OH (US)

( * ) Notice: Subject to any disclaimer, the term of this patent is extended or adjusted under 35 U.S.C. 154(b) by 0 days.

(21) Appl. No.: 14/863,507

(22) Filed: Sep. 24, 2015

(65) Prior Publication Data

US 2017/0087595 A1 Mar. 30, 2017

(51) Int. Cl.
*B07B 1/49* (2006.01)
*B07B 1/46* (2006.01)

(52) U.S. Cl.
CPC ..... *B07B 1/4681* (2013.01)

(58) Field of Classification Search
CPC ..... B07B 1/46; B07B 1/469
USPC ..... 209/397, 404, 405, 399
See application file for complete search history.

(56) References Cited

U.S. PATENT DOCUMENTS 2,723,032 A * 11/1955 Jelks ..... B07B 1/4663 209/401
3,169,475 A 2/1965 Caouette
3,176,843 A 4/1965 Hoskins et al.
3,585,134 A * 6/1971 Schmidt et al. ..... B01D 29/012 210/495
4,224,146 A 9/1980 Kent et al.
5,226,546 A 7/1993 Janssens et al.
5,392,925 A 2/1995 Seyffert
5,927,511 A 7/1999 Riddle et al.
5,958,236 A * 9/1999 Bakula ..... B01D 29/012 209/329
5,967,336 A * 10/1999 Baltzer ..... B01D 33/0376 209/403
6,053,329 A 4/2000 Ballman
6,070,736 A 6/2000 Ballman et al.
6,073,979 A 6/2000 Nawalaniec et al.
6,763,948 B2 7/2004 Ballman et al.
7,000,777 B2 * 2/2006 Adams ..... B01D 29/012 209/399
8,113,358 B2 * 2/2012 Smith ..... B07B 1/4618 209/399

(Continued)

*Primary Examiner* — Terrell Matthews
(74) *Attorney, Agent, or Firm* — Wood Herron & Evans LLP

(57) ABSTRACT

A screen panel has a pre-tensioned screen with a polished metal plate mounted to the top of the frame to eliminate all the exposed surface areas of epoxy which secures the screen to the screen panel frame. The metal plate also provides an edge against which a silicone bead may be seated to provide a much cleaner and finished looking panel which is anticipated to meet the standards set forth by the USDA. Additionally, the spatial positioning of the plate atop the screen material and screen frame allows for a clean and smooth transition across the components and one which may accept a finished bead of silicon or other material for reducing and/or eliminating sites for mold growth or other containments thereby enhancing the ability to clean and sterilize the screen panel for the processing of various materials.

19 Claims, 5 Drawing Sheets

(56) References Cited

U.S. PATENT DOCUMENTS

| | | | | |
|---|---|---|---|---|
| 8,261,915 | B2 | 9/2012 | Bailey et al. | |
| 8,522,981 | B2 | 9/2013 | Ballman | |
| 2003/0066786 | A1 | 4/2003 | Seyffert et al. | |
| 2004/0007508 | A1 | 1/2004 | Schulte et al. | |
| 2004/0251175 | A1* | 12/2004 | Adams | B01D 29/012 209/399 |
| 2013/0193037 | A1* | 8/2013 | Dressler | B07B 1/4645 209/405 |
| 2013/0277281 | A1* | 10/2013 | McClung, III | B07B 1/46 209/346 |
| 2016/0062523 | A1* | 3/2016 | Jeong | G02F 1/133308 349/12 |

* cited by examiner

SCREEN PANEL FRAME WITH PLATE

BACKGROUND OF THE INVENTION

This invention relates to screening machines of the type used to separate or classify mixtures of particles of different sizes. More particularly, the invention relates to an improved screen panel for use within such a screening machine.

In screening machines of the type described, a screen (which may be woven, an aperture plate or another design) is mounted in what is often called a "screen frame" or "screen deck" which includes a supporting peripheral frame around the perimeter of the screen. Some screens are tensioned when they are installed in the screening machine and other screens are pre-tensioned in a frame prior to being installed in the machine. Typically associated with the screen deck are additional material handling elements that are moved with the screen and form walls or partitions above or below the screen for containing the liquid and/or particulate materials adjacent to the screen and directing them to appropriate outlets. These elements may comprise a top cover and a pan beneath the screen deck. In the case of screening machines with multiple screens or deck units, spacer pans or frames are provided between the multiple screens.

The screens are often removed from the screening machines for cleaning, replacement, readjustment, or installation of a screen of a different mesh size or the like. The screen is releasably mounted to a carrier, table or box to which vibratory motion is imparted, typically by one or more eccentric motors or other means of excitation. The carrier, table or box is referred to herein as a "vibratory carrier". The vibratory carrier may be moved in oscillatory, vibratory, gyratory, gyratory reciprocating, fully gyratory, rotary or another type of motion or combinations thereof, all of which are herein collectively referred to as "vibratory" motion or variations of that term.

Screening machines of this type are used to separate or classify a wide variety of materials. Some of the materials which are processed in these screening machines are subject to various governmental regulations and/or other requirements during the handling and processing of the materials. These requirements and regulations often include cleanliness and sanitary standards for certification under the United States Department of Agriculture (USDA) regulations. USDA certification would then allow use of such a screening machine in the production and processing of protein products such as whey powder, milk powder, cheese, etc. The processing and handling of these and other types of products require USDA certification.

One challenge to satisfying the USDA certification standards for screen panels and screening machines has been a pre-tensioned screen panel that could meet the performance aspects of a standard screen panels as well as meet the cleanliness standards set by the USDA. Existing pre-tensioned screen panels typically have wire tensioned over a tubular frame and fastened to the frame using a Food and Drug Administration (FDA) approved epoxy. A bead of silicone may be located between the edge of the tubular frame and the wire interface to act as a damper to prevent wire fatigue. Various problems with such a screen panel design for satisfying the USDA requirements include the fact that the epoxy creates bubbles during the curing process and thereby create pores in which bacteria may collect and grow. Moreover, the epoxy interface with the screen panel components is often uncontrolled and does not have a clean appearance thereby creating more sites for potential mold growth. Additionally, when the epoxy presses through the screen wire, it creates fingers, or a series of protrusions that can either break off into the product being screened or create a cavity for bacteria to collect and grow.

SUMMARY OF THE INVENTION

The above-described and other problems with prior art screening machines and associated screen panels have been resolved by this invention. Screening machines and screen panels according to various embodiments of this invention utilize a perforate screen assembly engaging the machine frame, and a driver imparting vibratory motion to the screen assembly, the machine frame and screen assembly designed to hold particulate matter to be screened. The screening machine also includes a first outlet which discharges a first portion of the particulate matter that remains on top of the screen assembly and a second outlet which discharges a second portion of the particulate matter that passes through the screen assembly.

One aspect of this invention is the screen assembly including a screen panel having a generally planar screening surface. In various embodiments, the screen panel of this invention utilizes a pre-tensioned screen with a polished metal plate glued to the top of the frame to eliminate all the exposed surface areas of epoxy which secures the screen to the screen panel frame. The metal plate also provides an edge against which a silicone, epoxy or other material bead is seated to provide a much cleaner and finished looking panel which is anticipated to meet the standards set forth by the USDA. Additionally, the spatial positioning of the plate atop the screen material and screen frame allows for a clean and smooth transition across the components and one which may accept a finished bead of silicon or other material for reducing and/or eliminating sites for mold growth or other containments thereby enhancing the ability to clean and sterilize the screen panel for the processing of various materials.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
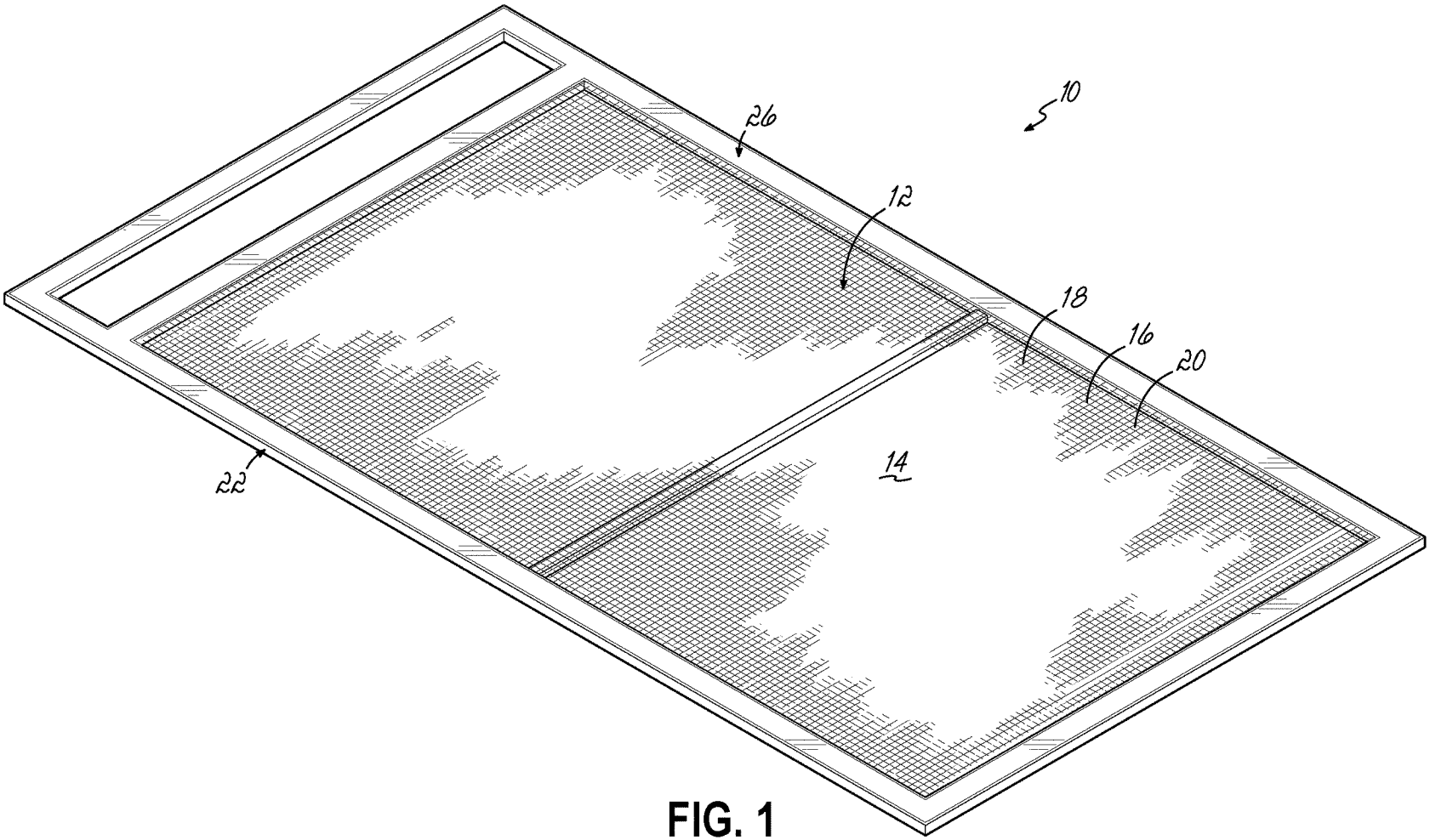
FIG. 1 is a perspective view of an exemplary screen panel according to one embodiment of this invention.
Figure 2:
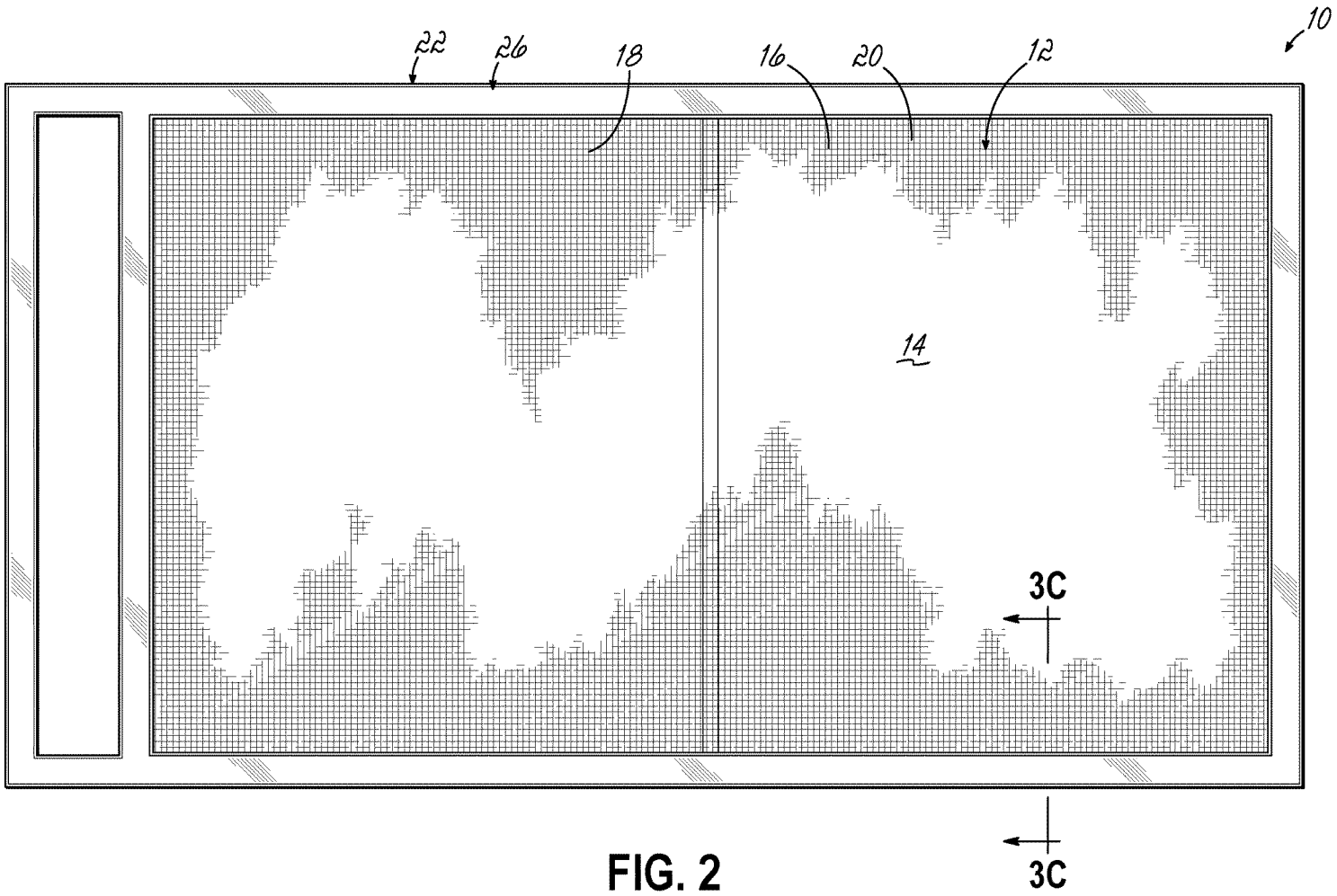
FIG. 2 is a top plan view of the screen panel of FIG. 1.

Referring to FIG. 1, an exemplary embodiment of a screen panel 10 according to this invention is shown. The screen panel 10 maybe used in a screening machine, many types of which are sold commercially by Rotex Global LLC of Cincinnati, Ohio, the assignee of this invention. However, this invention is not limited to any particular type of screening machine design or application and the machine disclosed herein is for illustrative purposes. Exemplary screening machines are disclosed in U.S. Pat. Nos. 8,522,981; 8,261,915; 6,763,948; 6,073,979; and 6,070,736, each of which is hereby incorporated by reference in its entirety.

Within a screening chamber of the screening machine, one or more screen panels 10 are each mounted to receive the material being screened from a feed chute at the head end of the screening machine. The screen panels 10 are mounted on slightly sloping planes (approximately 4 degrees) with the head end thereof being slightly elevated relative to a foot end so that during the screening process the material advances, in part by gravity, over the screen panels 10 toward a discharge end of the machine. Even though the screen panels 10 of the screening machine may be on a slightly sloping plane, to provide a reference for the purposes of clarity herein, these components will be considered to be generally horizontal and the direction perpendicular or orthogonal to the screen panels 10 will generally be referred to as a vertical orientation or direction. The direction of travel of the material being screened from the head end to a discharge end across the screen panels 10 is referred to as the longitudinal direction and the perpendicular orientation extending from side to side on the screen panels 10 is a lateral direction.

Accordingly, as the material to be screened is deposited from the inlet port onto the screen panels 10, the vibratory motion of the screening machine advances the material longitudinally across the top of the screen panels 10 of the toward the discharge end. Appropriately sized and configured material passes through the screen panels 10. The screen panels 10 may include a fine mesh screen material 12 through which material passes for collection and discharge. Certain material may also pass through an upper screen panel 10 and is deposited on a lower screen panel 10. Therefore, the lower screen panels 10 may be included to provide an additional separating mechanism for the appropriately sized particles to pass through for collection in a lower pan (not shown).

The unacceptably sized particles remain atop the upper screen panels 10 and fall off the terminal edge thereof into a collection basin for discharge through an outlet (not shown). The acceptably sized particles that pass through both the upper and lower screen panels 10 are collected in a lower pan and discharged through an outlet (not shown) located at the discharge end of the machine.

Figure 3A:
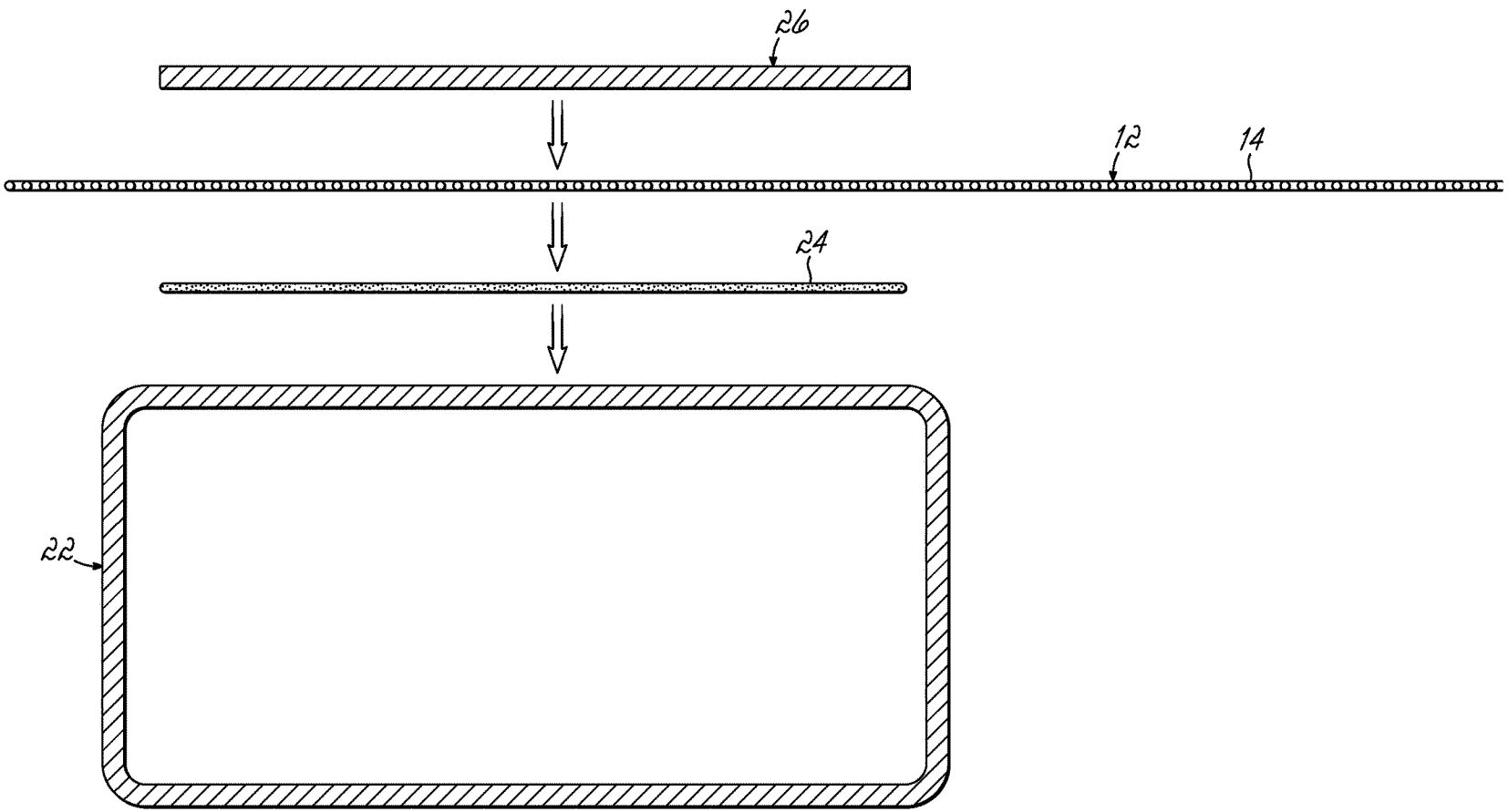
FIG. 3A is a cross-sectional view of the screen panel of FIGS. 1-2 taken along line 3C-3C of FIG. 2 with the components in a disassembled arrangement.
Figure 3B:
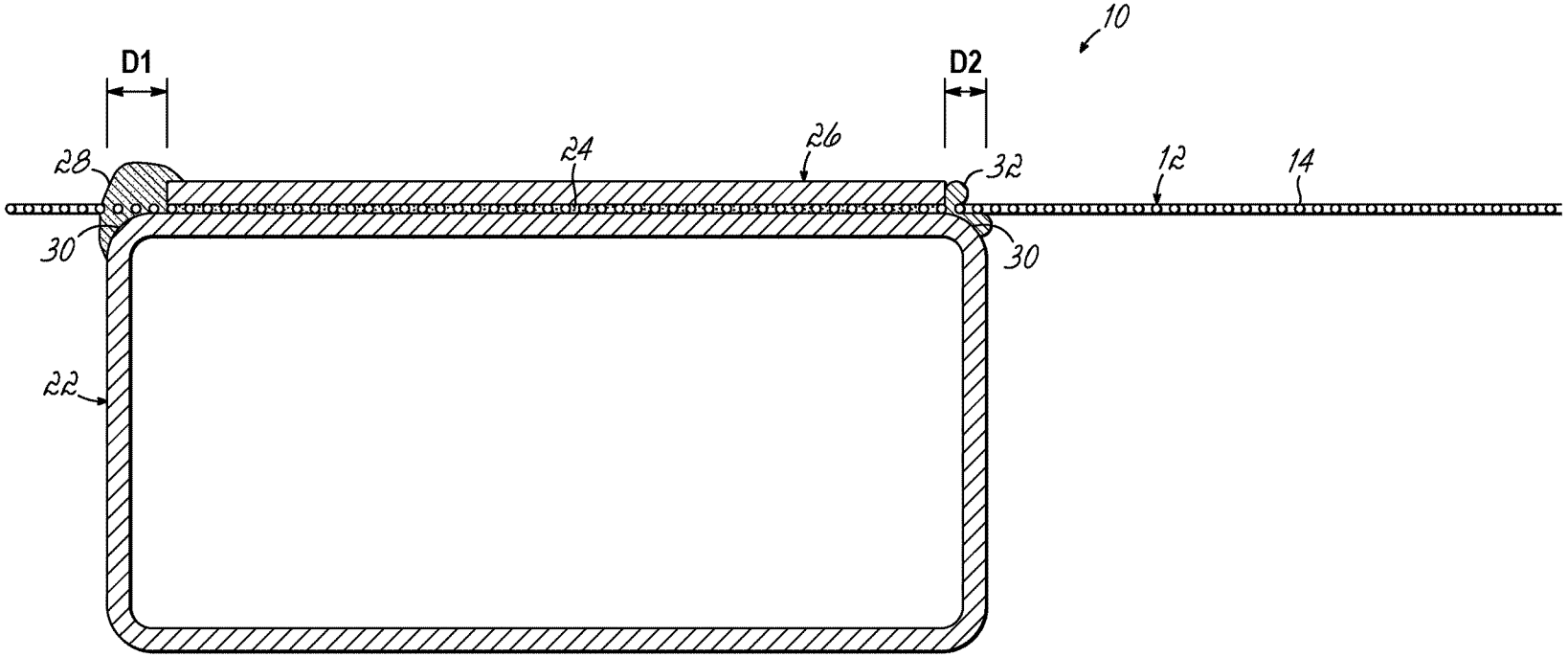
FIG. 3B is a view similar to FIG. 3A with the components assembled and a seal bead added.
Figure 3C:
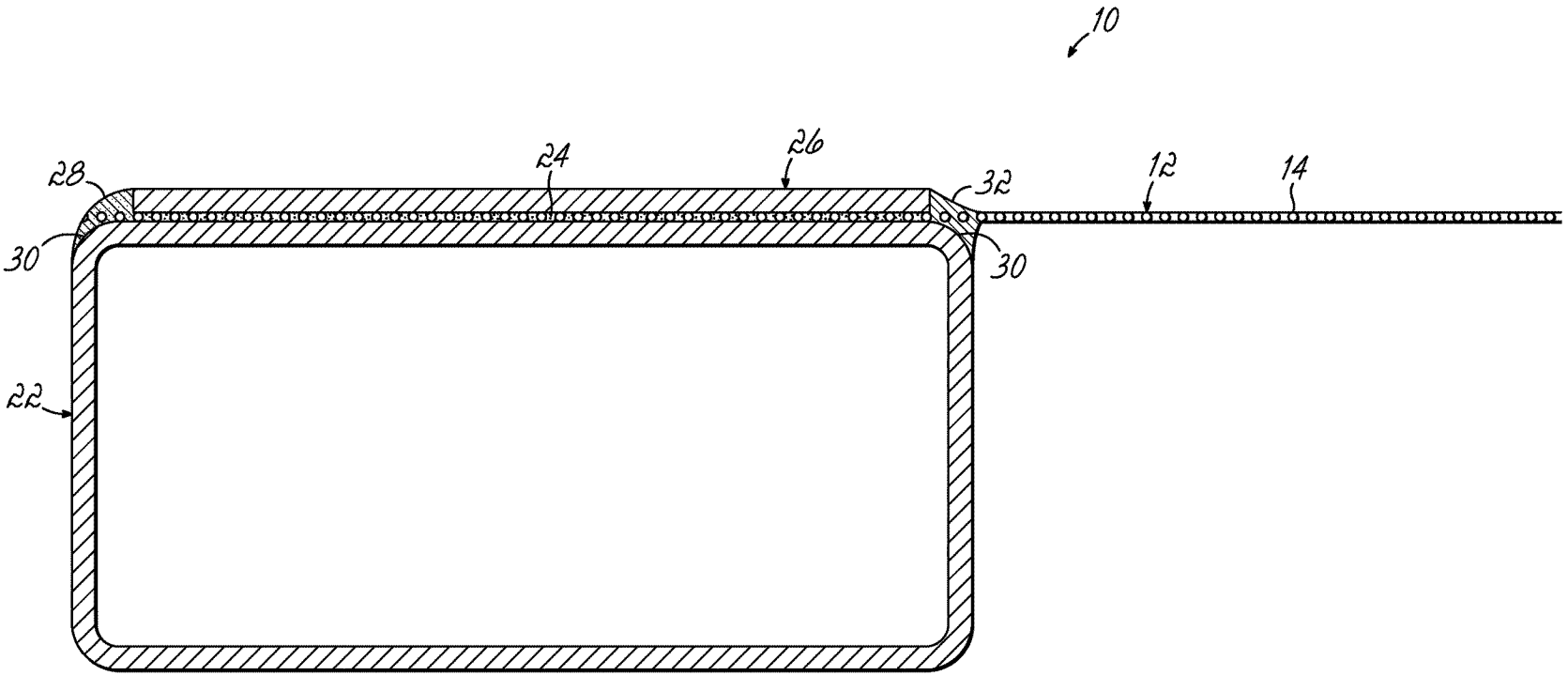
FIG. 3C is a view similar to FIG. 3B with the seal bead in a finished configuration.

Referring to FIGS. 1-3C, one embodiment of the screen panel 10 includes a generally perforated mesh screen material 12 making a screening surface 14. The mesh screen material 12 includes a number of intersecting longitudinal threads or wires 16 and lateral threads or wires 18 which are oriented orthogonally to each other to provide appropriately sized and configured openings 20 in the screening surface 14 to prevent or allow the passage of material. The screen panel 10 includes a generally rigid peripheral frame 22 extending around at least a portion of the screening surface 14. A cross-sectional profile of the frame 22 may have a generally rectangular configuration and provide the frame 22 with a tubular construction as shown in FIGS. 3A-3C. The tubular frame 22 may be aluminum or any other material appropriate for the design parameters of the screen panel 10. The screen material 12 of various embodiments of this invention is pre-tensioned on the frame 22 as distinguished from screen panels in which the screen material is otherwise stretched and locked onto a separate frame assembly.

The mesh screen material 12 may be bonded or adhered to the frame 22 by an epoxy 24 as shown in FIGS. 3A-3C. As it may be appreciated by those in the art, the epoxy 24 is initially a flowable material and oozes or migrates between the threads or wires 16, 18 of the screen material 12 prior to the epoxy 24 curing or setting up. Normally such an arrangement is appropriate to bond the screen material 12 to the frame 22 for many applications. However, as noted above, the epoxy 24 filtering through the screen material 12 often provides for an irregular surface and one which has many available sites for mold growth and the like and creates fingers of excess epoxy dangling from the frame or screen material. According to various embodiments of this invention, a plate 26 is positioned atop the frame 22, epoxy 24 and adjacent portions of the screen material to provide a smooth, clean and cavity free surface to this portion of the screen panel 10. In various embodiments, the plate 26 may have a generally frame-like configuration with a central opening to expose the screening surface 14 of the screen panel 10.

The plate 26 is adhered to the frame 22 and screen material by the epoxy 24 and conceals the epoxy 24 thereby eliminating epoxy fingers and sites for mold growth which would otherwise be presented. In various embodiments, the plate 26 may be stainless steel or another material which is readily susceptible to being cleaned, sterilized or otherwise prepared in accordance with applicable USDA regulations for the screening or processing of various food and other products. The plate 26 may be polished and may be an FDA approved material having a specified micro-finish consistent with such standards.

Unlike prior screen panels, the screen panel 10 of this invention presents a smooth clean upper surface atop the screen frame 22 and the epoxy 24 or other material securing the screen material 12 to the frame 22 is not exposed to offer sites for mold growth and the like. The plate 26 may be commensurate with the upper profile of the screen frame 22 as shown generally in FIG. 1. In other embodiments, the plate 26 covers the entire peripheral edge of the screen material 12 adhered to the screen frame 22. The plate 26 eliminates exposed epoxy on the finished screen panel 10 and is adhered to the frame 22 by the epoxy 24. As such, the tubular frame 22 with the screen material 12 and plate 26 adhered thereto form a single-piece screen panel 10 assembly.

As shown in FIGS. 3B-3C, a bead 28 of epoxy or other material may be added to the perimeter edge of the plate 26. The bead 28 may be trimmed via grinding, polishing or another technique to provide a smooth transition from the edge of the plate 26 to the outer face of the frame 22 as shown in FIG. 3C. The bead 28 may be trimmed after it is cured or hardened or prior to curing and hardening. The outer and/or inner perimeter edge of the plate 26 may be offset D1, D2 from the associated edge of the frame 22 so as to provide a seat 30 into which the silicone bead 28 resides and offer a cleaner and finished profile to the screen panel 10 and one which does not harbor mold or other contamination sites as in other designs.

With prior screen panel designs, a bead of epoxy and a bead of silicone are applied onto the tubular frame and the frame is pressed up into the pre-tensioned screen material causing the two beads to protrude through the wires of the screen material creating fingers of excess material. With embodiments of this invention, one or more beads of epoxy 24 can be placed onto the tubular frame 22 and the frame 22 pressed into the pre-tensioned screen material 12. Then the plate 26 is placed on top of the screen material 12 and frame 22 and clamped thereto to hold in place. Next, tape may be laid on top of the screen material 12 offset from the inside border of the plate 26. Then a bead 32 of silicone caulk is laid in the offset seat 30 and wiped with a finger across the caulk to force the caulk into the space between the tubular frame 22 and the plate 26. The bead of caulk may be any appropriate material for the application, construction and environment of the screen panel 10. The tape is then pulled off. In various embodiments of this invention, the plate 26 has a slightly smaller outer dimension and a slightly larger inner dimension creating offsets D1 and D2 relative to the associated edges of the frame 22 as shown in FIG. 3B. Therefore, when the silicone 32 is pressed through the screen material 12 with an operator's finger, the tubular frame 22 acts as a backing and prevents fingers of epoxy or silicone caulk being created on the backside of the screen panel 10. The silicone underneath the screen material 12 may line up with a top bead of silicone on top of the screen material thereby filling any voids or crevices.

In one embodiment of this invention, epoxy is used to seal along all the outside edges of the plate 26 and silicone is used along all the inside edges of the plate 26. The plate 26 covers the epoxy 24 for attaching the screen material 12 to the frame 22 which often contains any bubbles in the epoxy, but the outside edge of the plate 26 may be filled with a small bead of epoxy where the bubbles can be managed and the epoxy ground smooth.

The screen panel 10 may be manufactured by a variety of processes, including stretching the mesh screen material 12 to put longitudinal wires 16 and lateral wires 18 in tension, robotically applying epoxies or adhesives, curing with ultraviolet light for about 30 seconds, and trimming or grinding off any excess wire 16, 18. In some embodiments, the silicone bead can be installed on the perimeter where the ends of wires 16, 18 are exposed. In another embodiment, the screen panel 10 can be manufactured by dipping the frame 22 in epoxy 24 and pressing the mesh screen material 12 and plate 26 onto the frame 22 with a heat press.

The screen panel 10 of the current embodiment has several advantages over conventional screen panels, including for example the elimination of sites in which mold or other containments may be located so as to offer a screen panel 10 which is capable of meeting or exceeding standards set forth by the USDA and others for the processing of food related and other materials.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A screen panel assembly for use in a vibratory screening machine, the screen panel assembly comprising:

a frame;

a perforate screen material extending across the frame to provide a screening surface;

an epoxy securing perimeter portions of the perforate screen material to the frame; and a plate positioned atop the frame and sandwiching the epoxy and perimeter portions of the perforate screen material therebetween, the plate having a central opening to thereby expose the screening surface within the frame to allow for passage of material on the screening surface through the screen panel assembly, the plate concealing the perimeter portions of the perforate screen material, wherein the epoxy permanently secures the perimeter portions of the perforate screen material to both the frame and the plate.

2. The screen panel assembly of claim 1 wherein the frame is tubular.

3. The screen panel assembly of claim 1 wherein the perforate screen material has a plurality of intersecting longitudinal and lateral wires forming the screening surface.

4. The screen panel assembly of claim 1 wherein the plate is commensurate with the frame.

5. The screen panel assembly of claim 1 further comprising:

a seat defined by an offset of an edge of the plate relative to an edge of the frame; and a bead of caulk positioned with the seat to provide a continuous transition from the frame to the plate across the seat.

6. The screen panel of claim 1 wherein an edge of the plate is offset from a corresponding edge of the frame.

7. The screen panel of claim 1 wherein an outer edge of the plate is offset from an outer edge of the frame and an inner edge of the plate is offset from an inner edge of the frame.

8. The screen panel of claim 1 wherein the plate is stainless steel.

9. A screen panel assembly for use in a vibratory screening machine, the screen panel assembly comprising:

a tubular frame;

a perforate screen material extending across the frame to provide a screening surface, wherein the perforate screen material has a plurality of intersecting longitudinal and lateral wires forming the screening surface;

an epoxy permanently securing perimeter portions of the perforate screen material to both the frame and plate; and a stainless steel plate positioned atop the frame and sandwiching the epoxy and perimeter portions of the perforate screen material therebetween, the plate being commensurate with the frame and having a central opening to thereby expose the screening surface within the frame to allow for passage of material on the screening surface through the screen panel assembly, the plate concealing the perimeter portions of the perforate screen material;

wherein an outer edge of the plate is offset from an outer edge of the frame to define a first seat and an inner edge of the plate is offset from an inner edge of the frame to define a second seat;

a bead of caulk positioned with at least one of the first and second seats to provide a continuous transition from the frame to the plate across the associated seat.

10. A screening system comprising:

a vibratory screening machine;

a screen panel assembly for use in the vibratory screening machine;

the screen panel assembly comprising:

a frame;

a perforate screen material extending across the frame to provide a screening surface;

an epoxy permanently securing perimeter portions of the perforate screen material to both the frame and plate;

a plate positioned atop the frame and sandwiching the epoxy and perimeter portions of the perforate screen material therebetween, the plate having a central opening to thereby expose the screening surface within the frame to allow for passage of material on the screening surface through the screen panel assembly, the plate concealing the perimeter portions of the perforate screen material; and a non-porous bead of caulk contacting both an inner edge of the plate and the perforate screen material.

11. The screening system of claim 10 wherein the frame is tubular.

12. The screening system of claim 10 wherein the perforate screen material has a plurality of intersecting longitudinal and lateral wires forming the screening surface.

13. The screening system of claim 10 wherein the plate is commensurate with the frame.

14. The screening system of claim 10 further comprising:

a seat defined by an offset of an edge of the plate relative to an edge of the frame; and a bead of caulk positioned with the seat to provide a continuous transition from the frame to the plate across the seat.

15. The screening system of claim 10 wherein an edge of the plate is offset from a corresponding edge of the frame.

16. The screening system of claim 10 wherein an outer edge of the plate is offset from an outer edge of the frame and an inner edge of the plate is offset from an inner edge of the frame.

17. The screening system of claim 10 wherein the plate is stainless steel.

18. The screen panel assembly of claim 1 wherein the frame includes a tubular frame, such that the epoxy secures the perimeter portions of the perforate screen material directly to the tubular frame.

19. The screening system of claim 10 wherein the frame includes a tubular frame, such that the epoxy secures the perimeter portions of the perforate screen material directly to the tubular frame.

* * * * *